US010686287B2

(12) United States Patent
Weaver et al.

(10) Patent No.: US 10,686,287 B2
(45) Date of Patent: Jun. 16, 2020

(54) TERMINATION MACHINE WITH BLADE POSITION TOGGLE MECHANISM

(71) Applicant: TE CONNECTIVITY CORPORATION, Berwyn, PA (US)

(72) Inventors: Brian Keith Weaver, Harrisburg, PA (US); Todd Matthew Troutman, Elizabethtown, PA (US)

(73) Assignee: TE Connectivity Corporation, Berwyn, PA (US)

( * ) Notice: Subject to any disclaimer, the term of this patent is extended or adjusted under 35 U.S.C. 154(b) by 218 days.

(21) Appl. No.: 15/798,924

(22) Filed: Oct. 31, 2017

(65) Prior Publication Data

US 2019/0131754 A1 May 2, 2019

(51) Int. Cl.
*H01R 43/048* (2006.01)

(52) U.S. Cl.
CPC ..... *H01R 43/048* (2013.01)

(58) Field of Classification Search
CPC ..... H01R 43/04; H01R 43/048; H01R 43/052
See application file for complete search history.

(56) References Cited

U.S. PATENT DOCUMENTS 4,667,397 A * 5/1987 Day ..... H01R 43/052 29/33 F
4,718,160 A * 1/1988 Bulanda ..... H01R 43/055 226/196.1
4,805,278 A * 2/1989 Bulanda ..... H01R 43/055 29/33 M
5,491,887 A * 2/1996 Quinn ..... H01R 43/048 29/753
5,752,405 A * 5/1998 Gerst ..... H01R 43/048 72/312
5,967,395 A * 10/1999 Ito ..... H01R 43/055 226/168
6,530,257 B2 * 3/2003 Ooji ..... H01R 43/055 29/753
6,655,013 B2 * 12/2003 Wilson ..... H01R 43/048 29/33 M
7,565,735 B2 * 7/2009 Garner, Jr. ..... H01R 43/055 29/751
2007/0079501 A1 * 4/2007 Garner, Jr. ..... H01R 43/055 29/753
2010/0071203 A1 * 3/2010 Blickenstorfer ..... H01R 43/048 29/753

* cited by examiner

*Primary Examiner* — Carl J Arbes

(57) ABSTRACT

A termination machine includes a ram, a shearing arm, and a toggle mechanism. The ram moves reciprocally relative to a stationary anvil between an extended position and a retracted position during a crimp stroke and crimps a terminal against the anvil while moving towards the extended position. The shearing arm is mounted to the ram and moves with the ram along a portion of the crimp stroke. The shearing arm includes a blade at a distal end thereof and a post projecting laterally from the shearing arm. The toggle mechanism is operatively connected to the post of the shearing arm. The toggle mechanism selectively toggles the shearing arm between a cutting position and a non-cutting position of the shearing arm relative to the ram. The blade of the shearing arm projects farther beyond a crimp end of the ram in the cutting position than in the non-cutting position.

20 Claims, 9 Drawing Sheets

TERMINATION MACHINE WITH BLADE POSITION TOGGLE MECHANISM

BACKGROUND OF THE INVENTION

The subject matter herein relates generally to powered termination machines used for repetitively mechanically crimping electrical terminals onto wires.

Powered termination machines have been used in the connector industry to effect high-speed mass termination of various cables. The termination machine includes a moveable component, called a ram, that moves towards and away from a base or anvil component during a crimp stroke. As the ram moves towards the anvil, crimp tooling on the ram engages and compresses a barrel of an electrical terminal against the anvil, causing the barrel to bite into one or more electrical wires extending into the barrel to permanently attach and electrically connect the terminal to the wire(s), producing an electrical lead.

The terminals are typically fed to the termination machine attached to one another on a carrier strip. Some known termination machines include a shearing blade mounted to the ram. During the crimp stroke, the shearing blade is configured to strike an intermediary or bridge segment of the carrier strip between two adjacent terminals to sever the bridge segment, separating the two terminals from one another. In known termination machines, the shearing blade is secured in a fixed position relative to the ram. Thus, based on the position of the shearing blade, the shearing blade either severs every bridge segment of the carrier strip between adjacent terminals during a sequence of crimp strokes or, alternatively, does not sever any bridge segments, leaving the bridge segments intact. To switch the position of the shearing blade (e.g., from a cutting position to a non-cutting position or vice-versa), an operator may be required to deactivate the termination machine and then manually adjust the fixed position of the shearing blade on the ram.

In some connector applications, it is desirable to produce electrical leads that have a group of connected terminals, such as three terminals for example. The group of connected terminals allows the electrical leads to electrically connect and more wires than would be able to fit within a single barrel of a terminal. For example, if a single terminal can accommodate three wires, then a group of three terminals can electrically connect nine wires. In the group, the two bridge segments of the carrier strip between the three terminals are left intact, providing a conductive pathway between the terminals.

In order to produce a multitude of such three-terminal leads using a known termination machine, an operator first sets the shearing blade to a non-cutting position (or removes the shearing blade from the ram). One option is to run the machine for many crimp strokes to produce a long series of connected, crimped terminals, and then subsequently manually break off corresponding bridge segments of the carrier strip to isolate groups of three connected terminals. Another option is to run the machine for two crimp strokes, then stop the machine and switch the shearing blade to the cutting position before running the machine for another crimp stroke for the shearing blade to sever the bridge segment, yielding a discrete three-terminal group. But, to produce additional three-terminal leads, the operator must then stop the machine and reset the shearing blade in the non-cutting position before repeating the process. Both of these identified options are inefficient and require significant operator intervention, either for adjusting the position of the shearing blade or for manually breaking the bridge segments of the carrier strip.

A need remains for a powered termination machine that efficiently and automatically produces electrical leads having multiple attached terminals.

BRIEF DESCRIPTION OF THE INVENTION

In an embodiment, a termination machine is provided that includes a ram, a shearing arm, and a toggle mechanism. The ram moves reciprocally relative to a stationary anvil between an extended position and a retracted position during a crimp stroke. The ram is attached to crimp tooling at a crimp end of the ram. The crimp tooling crimps a terminal against the anvil as the ram moves to the extended position. The shearing arm is mounted to the ram and moves with the ram along a portion of the crimp stroke. The shearing arm includes a blade at a distal end thereof and a post projecting laterally from the shearing arm. The toggle mechanism is operatively connected to the post of the shearing arm. The toggle mechanism selectively toggles the shearing arm between a cutting position and a non-cutting position of the shearing arm relative to the ram. The blade of the shearing arm projects farther beyond the crimp end of the ram in the cutting position than in the non-cutting position.

In an embodiment, a termination machine is provided that includes a shearing arm and a toggle mechanism. The shearing arm is mounted to a ram and moves with the ram towards and away from a stationary anvil along a crimp stroke of the ram. The shearing arm extends to a distal end thereof and includes a blade at the distal end that projects beyond a crimp end of the ram. The shearing arm includes a post extending laterally from the shearing arm. The toggle mechanism is operatively connected to the post of the shearing arm to selectively toggle the shearing arm between a cutting position and a non-cutting position of the shearing arm relative to the ram. The blade of the shearing arm projects farther beyond the crimp end of the ram in the cutting position than in the non-cutting position. The toggle mechanism includes a blade switch that engages the post and a powered actuator connected to the blade switch. The powered actuator automatically moves the blade switch relative to the ram and the post of the shearing arm between first and second positions of the blade switch to toggle the shearing arm between the cutting position and the non-cutting position.

In an embodiment, a termination machine is provided that includes a ram, a shearing arm mounted to the ram, and a blade switch mounted to the ram. The ram has a mounting end and a crimp end and extends along a ram axis between the mounting end and the crimp end. The ram moves along a crimp stroke relative to a stationary anvil. The crimp end is attached to crimp tooling that crimps a terminal against the anvil. The shearing arm includes a blade at a distal end thereof and a post projecting laterally from the shearing arm. The shearing arm is biased by one or more springs towards the mounting end of the ram. The blade switch is mounted to the ram between the mounting end and the post of the shearing arm. The blade switch includes a cam backstop surface that engages the post of the shearing arm and blocks movement of the shearing arm towards the mounting end. The blade switch is selectively movable perpendicular to the ram axis to toggle the shearing arm between a cutting position and a non-cutting position of the shearing arm relative to the ram. The blade of the shearing arm projects farther beyond the crimp end of the ram in the cutting position than in the non-cutting position.

DETAILED DESCRIPTION OF THE INVENTION

Figure 1:
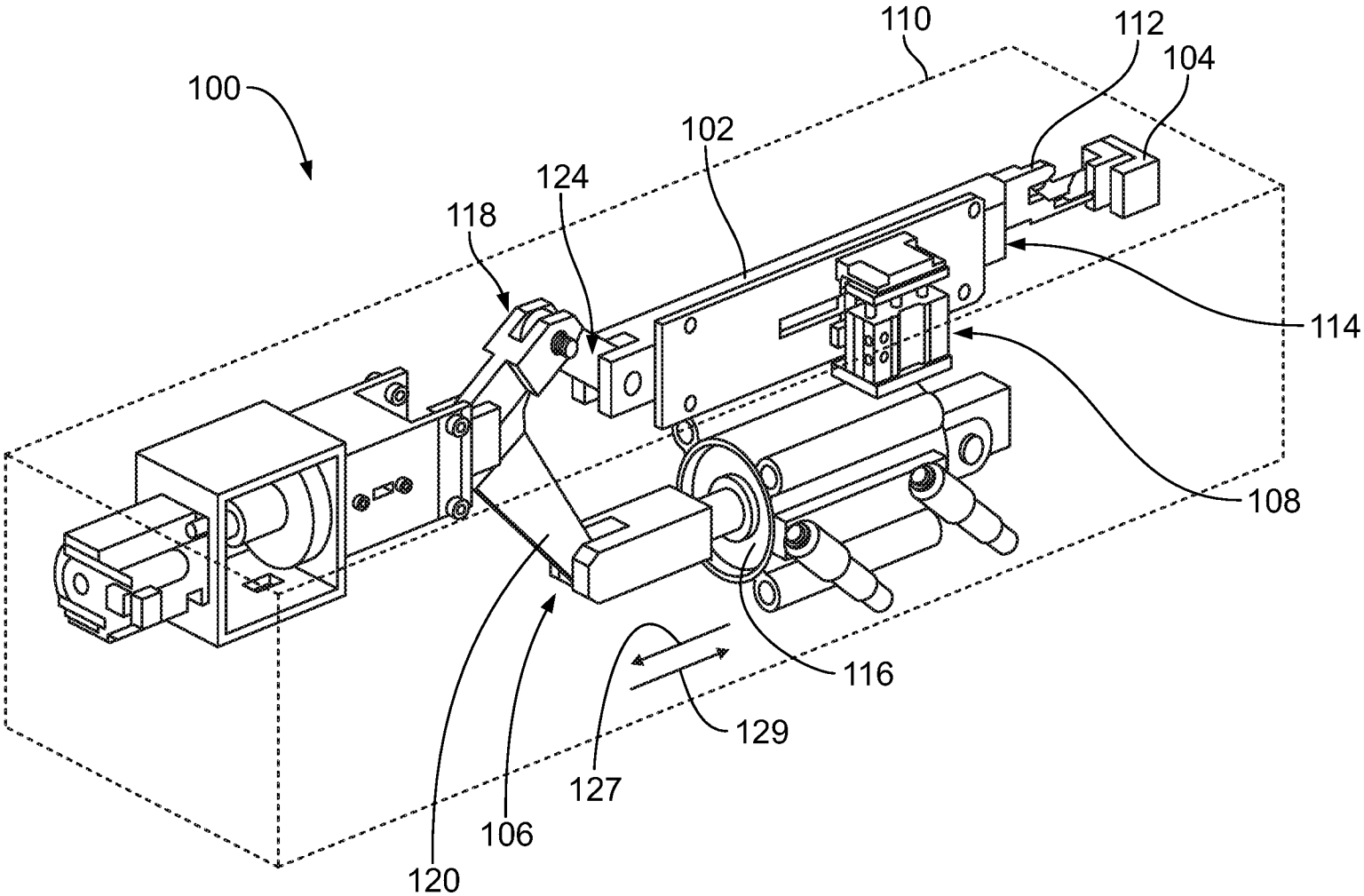
FIG. 1 is a front perspective view of a powered termination machine according to an embodiment.

FIG. 1 is a front perspective view of a powered termination machine 100 according to an embodiment. The powered termination machine 100 is configured to repeatedly crimp terminals 202 (shown in FIG. 2) onto corresponding wires 204 (FIG. 2) to produce a series of electrical leads for use in various applications, such as machines, appliances, automobiles, and the like. For example, in one specific application, the wires 204 may be magnet wires used for electrical windings of an induction motor, generator, transformer, or the like. The termination machine 100 may crimp one or multiple magnet wires 204 into each terminal 202 to electrically connect the magnet wires 204.

The termination machine 100 in the illustrated embodiment includes a movable ram 102, a stationary anvil 104, a drive assembly 106 operatively connected to the ram 102, and a shearing assembly 108. The termination machine 100 also includes a housing 110 or case that is shown in phantom. The housing 110 at least partially surrounds the other components 102, 104, 106, 108 of the termination machine 100 to prevent injuries to operators, block the entrance of debris and contaminants into the termination machine 100, and the like. The anvil 104 is secured in a fixed position relative to the housing 110. For example, the anvil 104 may be secured directly to the housing 110 or to a base within the housing 110. The shearing assembly 108 is operatively connected to the ram 102. The shearing assembly 108 is configured to selectively break or sever bridge segments 210 (shown in FIG. 2) of a carrier strip 208 (FIG. 2) between adjacent terminals 202 (FIG. 2) on the carrier strip 208.

The ram 102 moves reciprocally relative to the anvil 104 between an extended position and a retracted position. The ram 102 is located closer to the anvil 104 in the extended position than the proximity of the ram 102 to the anvil 104 in the retracted position. During a crimp stroke of the ram 102, the ram 102 moves from the retracted position towards the anvil 104 to the extended position, and subsequently retreats in a direction away from the anvil 104 to the retracted position to complete the crimp stroke. As the ram 102 moves towards the anvil 104 (and the extended position) during the crimp stroke, the ram 102 crimps a corresponding terminal 202 (FIG. 2) against the anvil 104. For example, the ram 102 includes crimp tooling 112 that extends from a crimp end 114 of the ram 102. The crimp tooling 112 engages the terminal 202 and compresses or sandwiches the terminal 202 between the crimp tooling 112 and the anvil 104 to crimp the terminal 202 onto the one or more wires 204 (FIG. 2) within the terminal 202.

In the illustrated embodiment, the drive assembly 106 includes an actuator 116 that is mechanically connected to the ram 102 via a linkage 118. The linkage 118 includes a bell crank or rocker 120. The actuator 116 is a linear pneumatic cylinder in the illustrated embodiment, but may be another type of powered actuator, such as an electrical step motor, a hydraulic actuator, a magnetic actuator, or the like, in an alternative embodiment. For example, although not shown, the actuator 116 may be coupled to an air hose that supplies pressurized gas to the actuator 116 to provide a source of power. The rocker 120 is pivotally connected to a mounting end 124 of the ram 102. The mounting end 124 is opposite to the crimp end 114 of the ram 102 that couples to the crimp tooling 112. The ram 102 is disposed vertically above the actuator 116. Due to the function of the rocker 120, movement of the linear actuator 116 in one direction drives the ram 102 in an opposite direction. For example, the actuator 116 moves in a first direction 127 towards the rocker 120 to drive the ram 102 along the crimp stroke towards the extended position and the anvil 104, and the actuator 116 moves in a second direction 129 away from the rocker 120 to retract the ram 102.

Figure 2:
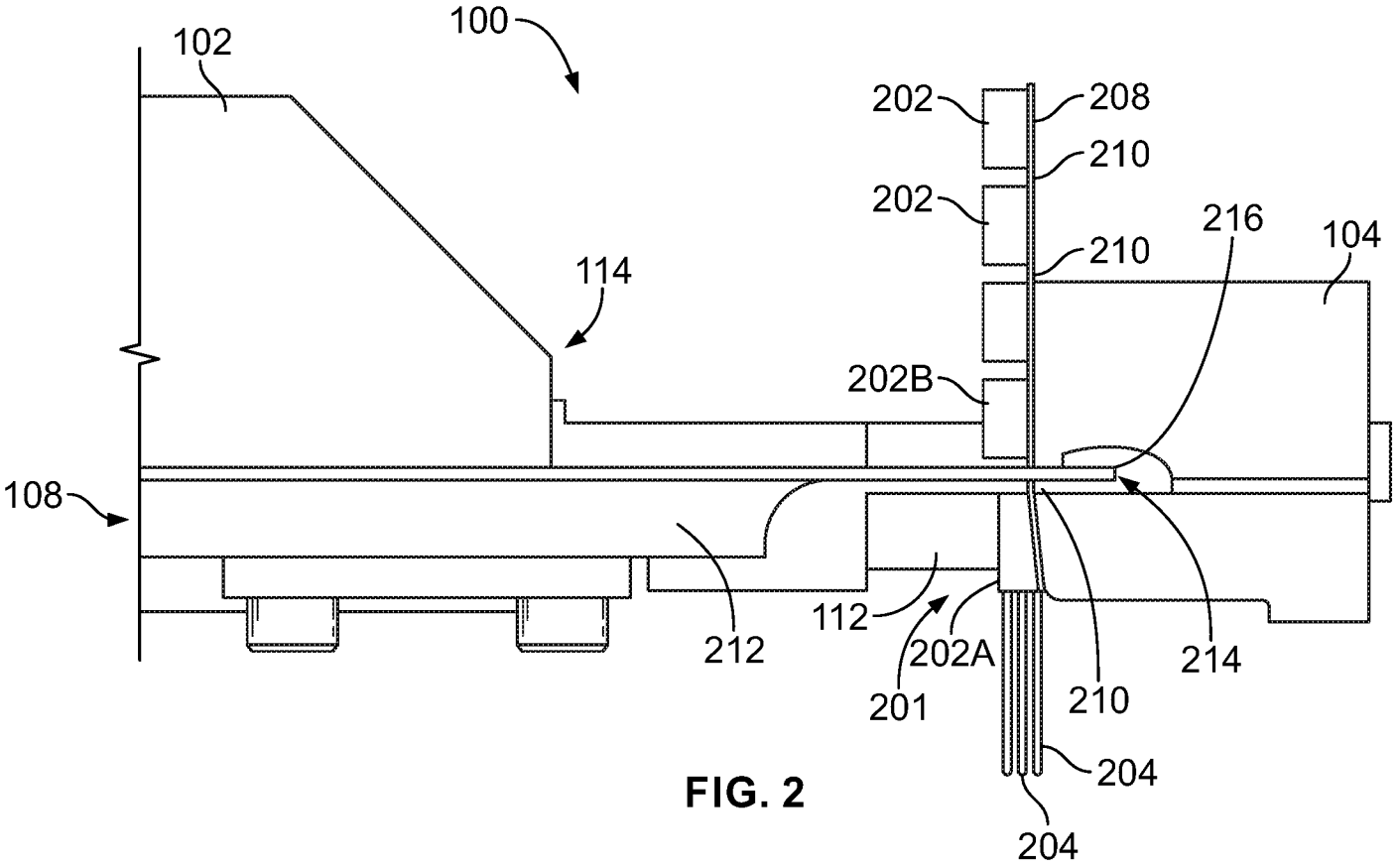
FIG. 2 is a top-down illustration showing a crimp zone of the termination machine that includes an anvil and crimp tooling at a crimp end of a ram according to an embodiment.

FIG. 2 is a top-down illustration showing a crimp zone 201 of the termination machine 100 that includes the anvil 104 and the crimp tooling 112 at the crimp end 114 of the ram 102. A series of terminals 202 on a carrier strip 208 are fed to the crimp zone 201. The terminals 202 may be fed to the crimp zone 201 by an automated feeder device (not shown).

The shearing assembly 108 includes a shearing arm 212 that is mounted to the ram 102. The shearing arm 212 moves with the movement of the ram 102 towards the anvil 104 during the crimp stroke. The shearing arm 212 projects beyond the crimp end 114 of the ram 102 to a distal end 214 of the shearing arm 212. The shearing arm 212 has a blade 216 at the distal end 214. The shearing arm 212 is adjustable relative to the ram 102 between a cutting position and a non-cutting position. The shearing arm 212 projects farther from the crimp end 114 of the anvil 104 in the cutting position than in the non-cutting position.

In FIG. 2, the ram 102 is in the extended position and the shearing arm 212 is in the cutting position. Prior to each crimp stroke, the carrier strip 208 is advanced such that one of the terminals 202, identified as 202A in FIG. 2, aligns between the anvil 104 and the crimp tooling 112. One or more wires 204 are loaded into a barrel of the terminal 202A. As the ram 102 moves towards the extended position during the crimp stroke, the crimp tooling 112 compresses the terminal 202A against the anvil 104, crimping the terminal 202A onto the wires 204. While the terminal 202A is crimped, the blade 216 of the shearing arm 212 strikes the bridge segment 210 of the carrier strip 208 that is between the crimped terminal 202A and the adjacent, uncrimped terminal 202, identified as 202B in FIG. 2. The blade 216 breaks through (e.g., severs) the bridge segment 210, mechanically separating the crimped terminal 202A from the uncrimped terminal 202B (and the other terminals 202 on the carrier strip 208).

As shown in FIG. 2, when the shearing arm 212 is in the cutting position, during each crimp stroke the blade 216 severs the bridge segment 210 of the carrier strip 208 between the terminal 202 being crimped and the adjacent, uncrimped terminal 202. As shown and described herein, when the shearing arm 212 is in the non-cutting position, the blade 216 does not sever the bridge segment 210 during the crimp stroke. As a result, the bridge segment 210 is left intact and the crimped terminal 202 (e.g., terminal 202A in FIG. 2) remains mechanically connected to the adjacent, uncrimped terminal 202 (e.g., terminal 202B).

Figure 3:
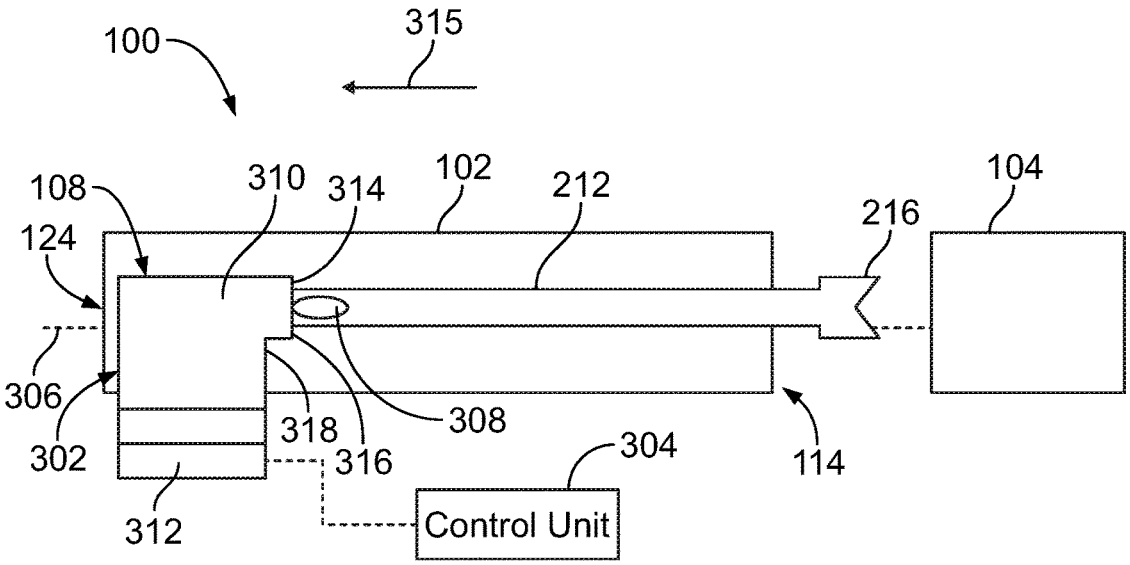
FIG. 3 is a schematic diagram of the termination machine according to an embodiment showing the ram in a retracted position and a shearing arm of a shearing assembly in a cutting position.
Figure 4:
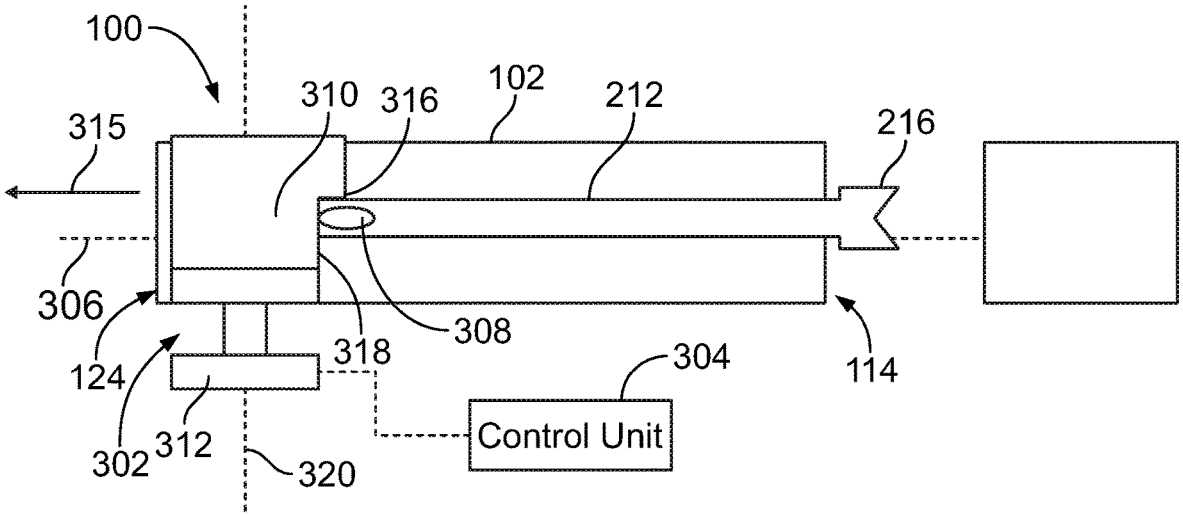
FIG. 4 is a schematic diagram of the termination machine according to an embodiment showing the ram in the retracted position and the shearing arm in a non-cutting position.
Figure 5:
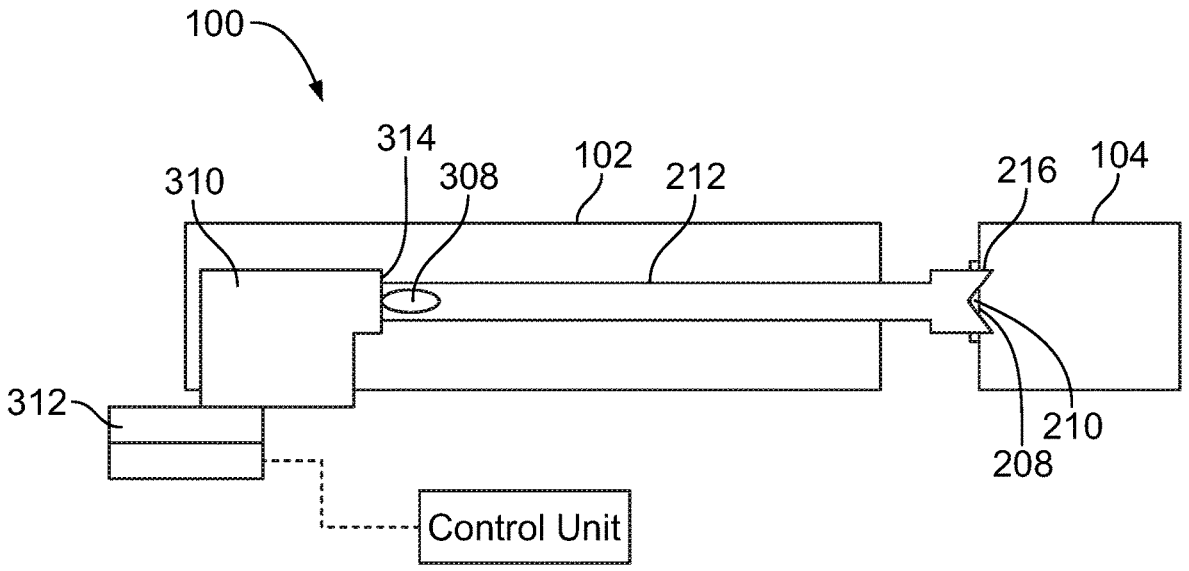
FIG. 5 is a schematic diagram of the termination machine according to an embodiment showing the ram in an extended position and the shearing arm in the cutting position, as in FIG. 3.
Figure 6:
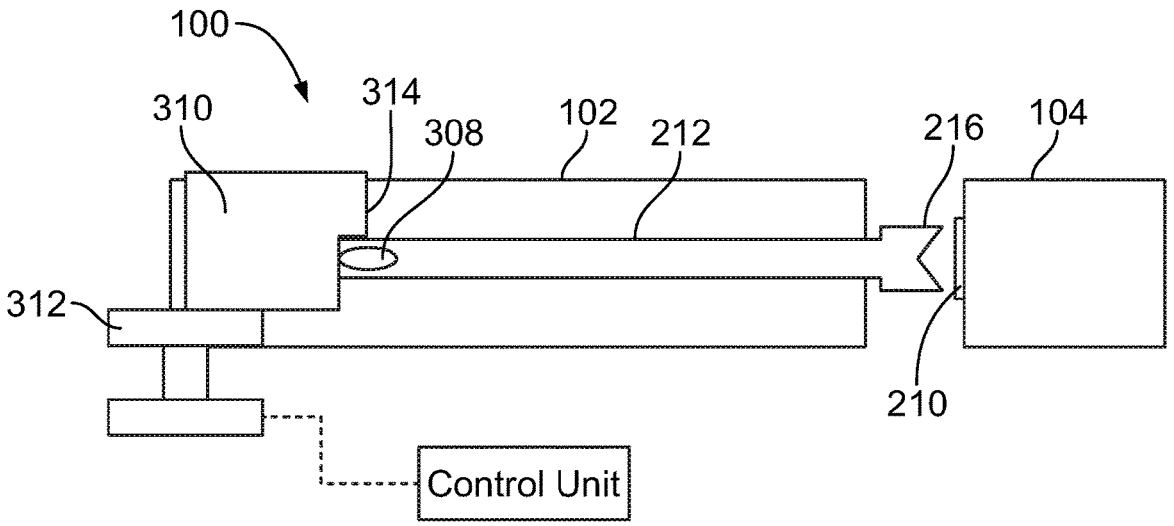
FIG. 6 is a schematic diagram of the termination machine according to an embodiment showing the ram in the extended position and the shearing arm in the non-cutting position, as in FIG. 4.

FIG. 3 is a schematic diagram of the termination machine 100 according to an embodiment showing the ram 102 in the retracted position and the shearing arm 212 of the shearing assembly 108 in the cutting position. The components of the termination machine 100 shown in FIG. 3, as well as in FIGS. 4-6, are schematically illustrated with simplified, generic shapes and sizes for descriptive purposes. The schematic components shown in FIGS. 3-6 may not correspond to the actual shapes and/or sizes of the associated physical, real-world components of the termination machine 100. The ram 102 extends from the mounting end 124 to the crimp end 114 along a ram axis 306.

In the illustrated embodiment shown in FIG. 3, the shearing assembly 108 includes the shearing arm 212, a blade position toggle mechanism 302 (referred to herein as toggle mechanism 302), and control unit 304. The shearing arm 212 is elongated parallel to the ram axis 306. The shearing arm 212 includes a post 308 projecting laterally from the shearing arm 212. In the illustrated embodiment, the post 308 projects out of the page. Optionally, the post 308 may extend from the arm 212 through an aperture 708 (shown in FIG. 7) of the ram 102.

The toggle mechanism 302 is operatively connected to the post 308 of the shearing arm 212. The toggle mechanism 302 is configured to selectively toggle the shearing arm 212 between the cutting position and the non-cutting position via engagement with the post 308. The control unit 304 controls the toggle mechanism 302. For example, the control unit 304 may include one or more processors and a memory. The one or more processors of the control unit 304 may control operations of the toggle mechanism 302 according to programmed instructions stored in the memory (e.g., software) or hard-wired into the control unit 304. The control unit 304 may allow an operator to select a designated toggle sequence for the shearing arm 212. Once the sequence is set, the toggle mechanism 302 may automatically toggle the shearing arm 212 between the cutting and non-cutting positions according to the designated toggle sequence.

The toggle mechanism 302 includes a blade switch 310 and a powered actuator 312 connected to the blade switch 310. The actuator 312 of the toggle mechanism 302 may be discrete from the actuator 116 of the termination machine 100 shown in FIG. 1. Alternatively, the actuator 312 may be connected to, or represent a part of, the actuator 116. The blade switch 310 is mounted to the ram 102 and moves with the ram 102 along the crimp stroke. The blade switch 310 may be disposed between the post 308 of the shearing arm 212 and the mounting end 124 of the ram 102. The blade switch 310 includes a cam backstop surface 314 that engages the post 308. In one or more embodiments, the shearing arm 212 is biased relative to the ram 102 in a retracting direction 315 towards the mounting end 124 of the ram 102 (e.g., and away from the anvil 104). The shearing arm 212 may be biased via one or more springs 808 (shown in FIG. 8), gravity, tension, or the like, that act on the shearing arm 212. Due to the biasing force exerted on the shearing arm 212, the post 308 of the shearing arm 212 presses against the cam backstop surface 314 of the blade switch 310. The cam backstop surface 314 provides a hard stop that blocks additional movement of the shearing arm 212 in the retracting direction 315 relative to the ram 102. The post 308 remains in engagement with the cam backstop surface 314 during at least a portion of the crimp stroke.

In an embodiment, the cam backstop surface 314 includes a high seat (portion) 316 and a low seat (portion) 318 adjacent to one another along the cam backstop surface 314. The high seat 316 is stepped a distance away from the low seat 318. The high seat 316 is located closer than the low seat 318 to the crimp end 114 of the ram 102. For example, the high seat 316 is between the low seat 318 and the crimp end 114 along the ram axis 306. In an embodiment, although the blade switch 310 is mounted to the ram 102, the blade switch 310 is movable relative to the ram 102 between a first position and a second position. The movement of the blade switch 310 between the first and second positions causes the shearing arm 212 to toggle between the cutting and non-cutting positions, as described herein. The actuator 312 drives the movement of the blade switch 310. In the first position of the blade switch 310 shown in FIG. 3, the post 308 of the shearing arm 212 aligns with and engages the high seat 316. When the post engages the high seat 316, the shearing arm 212 is in the cutting position.

FIG. 4 is a schematic diagram of the termination machine 100 according to an embodiment showing the ram 102 in the retracted position and the shearing arm 212 in the non-cutting position. From the cutting position shown in FIG. 3, the shearing arm 212 moves parallel to the ram axis 306 in the retracting direction 315 towards the mounting end 124 of the ram 102 to attain the non-cutting position. The blade 216 of the shearing arm 212 is located closer the crimp end 114 of the ram 102 in the non-cutting position relative to the cutting position.

In order to toggle the shearing arm 212 from the cutting position to the non-cutting position, the powered actuator 312 moves linearly to drive the blade switch 310, relative to both the ram 102 and the shearing arm 212, from the first position shown in FIG. 3 to the second position that is illustrated. In an embodiment, the actuator 312 moves the blade switch 310 between the first and second positions along a switch axis 320 that is perpendicular to the ram axis 306. The movement of the blade switch 310 along the switch axis 320 causes the shearing arm 212 to move in a direction that is approximately 90 degrees (e.g., within plus or minus 5, 10, 15 degrees) relative to the switch axis 320. When the blade switch 310 is in the second position, the post 308 of the shearing arm 212 aligns with and engages the low seat 318. For example, the actuator 312 extends, pushing the high seat 316 beyond the post 308 such that the low seat 318 aligns with the post 308. When the post 308 abuts the low seat 318, the shearing arm 212 is in the non-cutting position.

The powered actuator 312 may be a pneumatic actuator, an electrical actuator (e.g., motor), a hydraulic actuator, a magnetic actuator, or the like. As described above, the position of the shearing arm 212 is controlled by the actuator 312. For example, the shearing arm 212 assumes the cutting position in response to the actuator 312 moving the blade switch 310 to the first position such that the high seat 316 aligns with and engages the post 308 that is biased towards the blade switch 310. Furthermore, the shearing arm 212 assumes the non-cutting position in response to the actuator 312 moving the blade switch 310 to the second position such that the low seat 318 aligns with and engages the post 308.

In an embodiment, the operation of the actuator 312 may be controlled automatically by the control unit 304 in order to toggle the shearing arm 212 between the cutting and non-cutting positions according to a designated sequence. The sequence may include selected numbers of crimp strokes of the ram 102 before toggling the shearing arm 212. For example, one sequence may include setting the shearing arm 212 to the cutting position for one crimp stroke, in order to sever the bridge segment 210 of the carrier strip 208 (shown in FIG. 2), then toggling the shearing arm 212 to the non-cutting position for two subsequent crimp strokes, before repeating the sequence. This example sequence yields a plurality of crimped leads that each have three connected terminals 202 (FIG. 2). The two crimp strokes with the shearing arm 212 in the non-cutting position leaves a bridge segment 210 intact on both sides of the middle terminal 202. Other designated sequences may produce crimped leads having more or less than three connected terminals 202. Furthermore, the designated sequence may produce more than one type of lead. For example, one sequence may produce a selected number of one-terminal leads, followed by a selected number of two-terminal leads. The operator may select the designated sequence using an input device (not shown), such as a touchpad, keyboard, computer mouse, or the like, that communicates with the control unit 304. The control unit 304 may be configured to transmit a wired or wireless signal to the actuator 312 to control the movement of the actuator 312 according to the designated sequence.

In an embodiment, the toggle mechanism 302 switches the position of the shearing arm 212 from the cutting position to the non-cutting position, and vice-versa, while the ram 102 is at the retracted position shown in FIGS. 3 and 4. For example, after completing one crimp stroke and prior to starting a subsequent crimp stroke, the actuator 312 may be controlled to move the blade switch 310 in order to toggle the position of the shearing arm 212.

FIG. 5 is a schematic diagram of the termination machine 100 according to an embodiment showing the ram 102 in the extended position and the shearing arm 212 in the cutting position, as in FIG. 3. FIG. 6 is a schematic diagram of the termination machine 100 according to an embodiment showing the ram 102 in the extended position and the shearing arm 212 in the non-cutting position, as in FIG. 4.

Referring to both FIGS. 5 and 6, as the ram 102 moves from the retracted position towards the extended position (and the anvil 104), the blade switch 310 and the shearing arm 212 move with the ram 102. The post 308 of the shearing arm 212 may remain in biased engagement with the cam backstop surface 314 of the blade switch 310 during the movement. The actuator 312, however, does not move with the ram 102 along the crimp stroke. When the shearing arm 212 is in the cutting position shown in FIG. 5, the blade 216 of the shearing arm 212 engages and severs the bridge segment 210 of the carrier strip 208 as the ram 102 moves to the extended position. Conversely, when the shearing arm 212 is in the non-cutting position shown in FIG. 6, the blade 216 may be spaced apart from the bridge segment 210 without engaging the bridge segment 210, even at the extended position of the ram 102.

Figure 7:
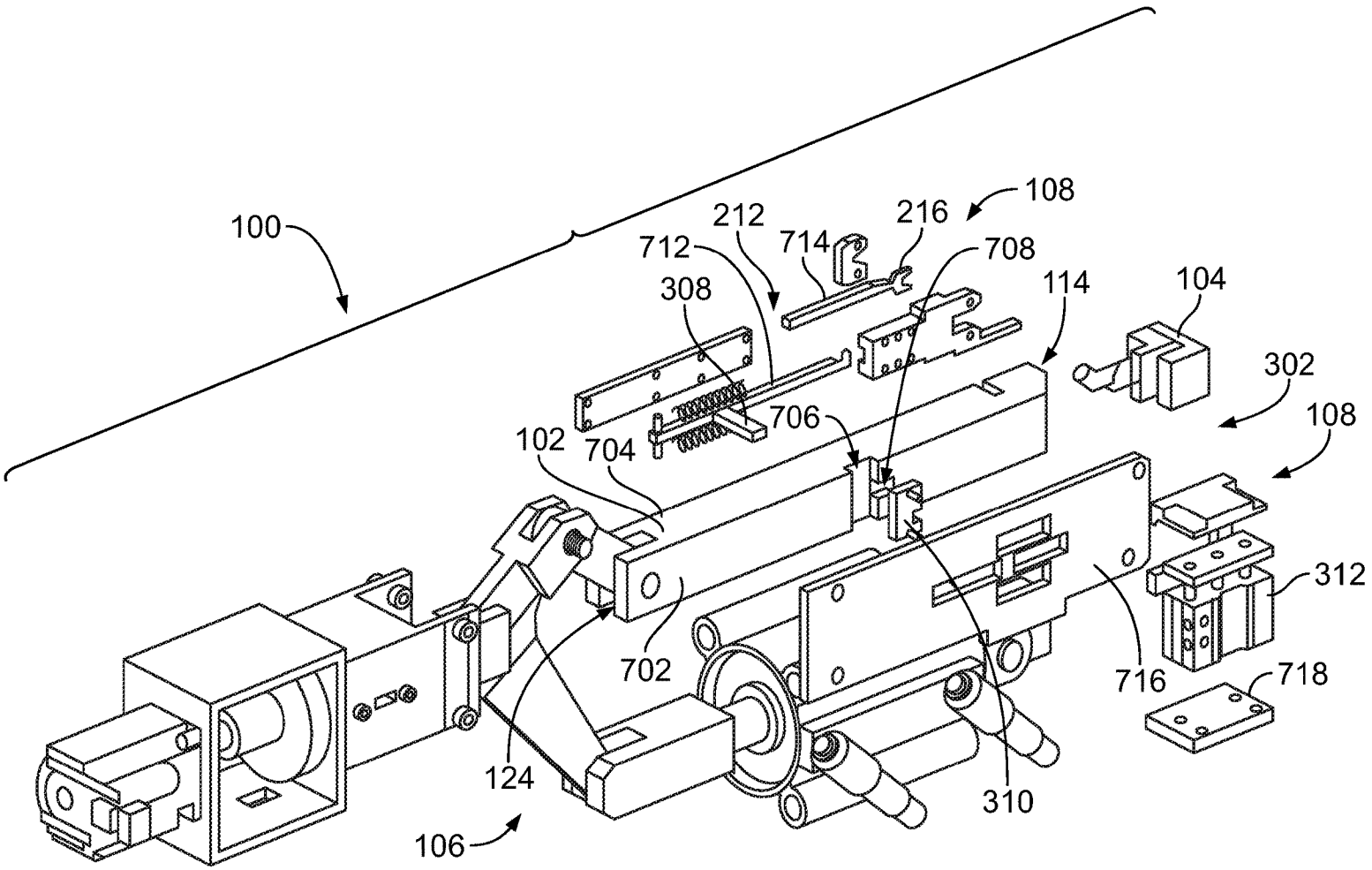
FIG. 7 is a perspective view of the termination machine according to an embodiment showing the shearing assembly exploded relative to the ram, the anvil, and a drive assembly.

FIG. 7 is a perspective view of the termination machine 100 according to an embodiment showing the shearing assembly 108 exploded relative to the ram 102, the anvil 104, and the drive assembly 106. The control unit 304 (shown in FIGS. 3-6) of the shearing assembly 108 is not shown in FIG. 7. The ram 102 includes a first side 702 and a second side 704 that is opposite to the first side 702. The first and second sides 702, 704 both extend between the mounting end 124 and the crimp end 114. In the illustrated embodiment, components of the shearing assembly 108 are disposed along opposite sides 702, 704 of the ram 102. For example, the toggle mechanism 302 is disposed along the first side 702, and the shearing arm 212 is disposed along the second side 704. The blade switch 310 of the toggle mechanism 302 may be configured for mounting to the first side 702 within a slot 706 of the ram 102. The shearing arm 212 is configured to be mounted on the second side 704 of the ram 102. In the illustrated embodiment, the post 308 of the shearing arm 212 is configured to extend through an aperture 708 in the ram 102 to engage the blade switch 310 along the first side 702 of the ram 102. The post 308 optionally may project beyond the first side 702.

In the illustrated embodiment, the shearing arm 212 is defined by a drive shaft 712 and a shear tooling member 714 that removably connects to the drive shaft 712. The drive shaft 712 includes the post 308, and the shear tooling member 714 includes the blade 216.

The termination machine 100 may include a fixed retaining plate 716 that is mounted to the housing 110 (shown in FIG. 1). The actuator 312 of the toggle mechanism 302 mounts to the fixed retaining plate 716 via a support base 718.

Figure 8:
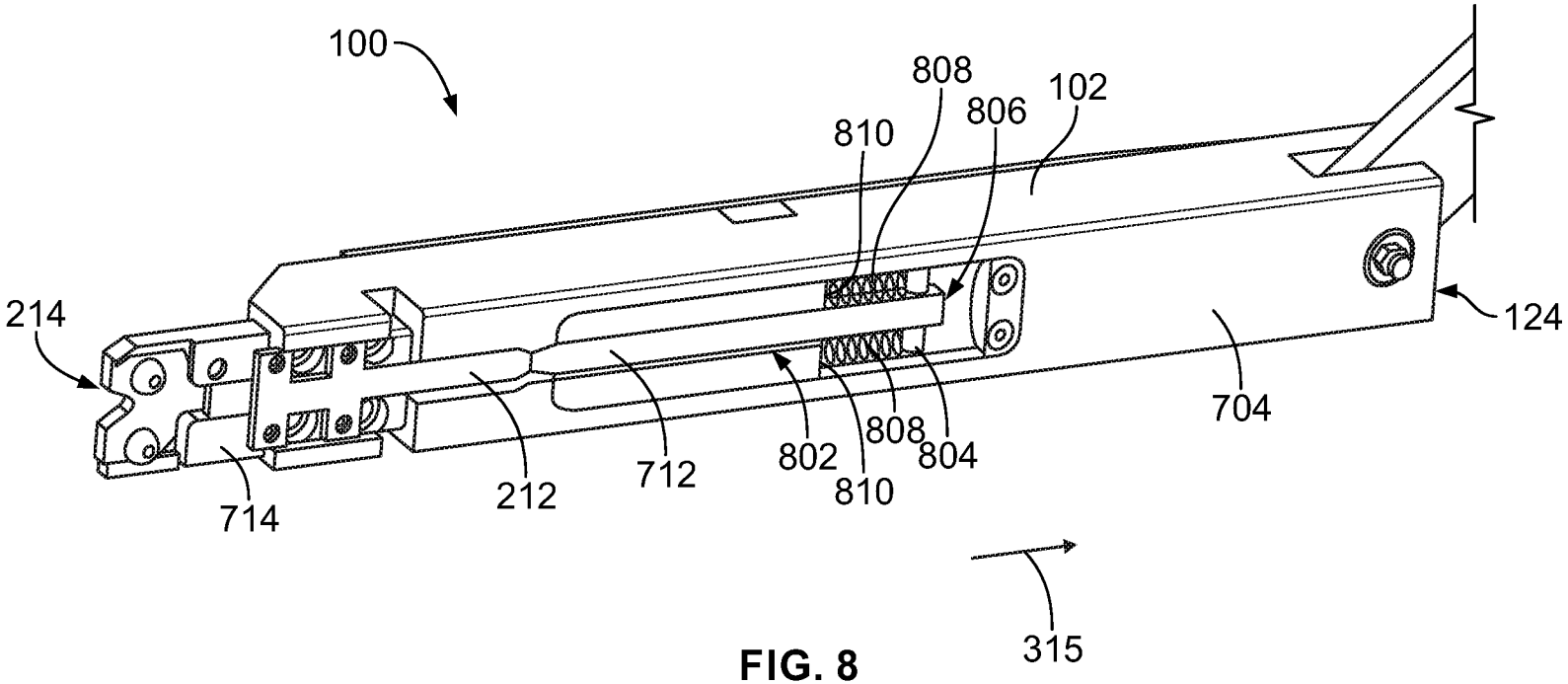
FIG. 8 is a perspective view of a portion of the termination machine according to an embodiment showing the shearing arm mounted along a second side of the ram.

FIG. 8 is a perspective view of a portion of the termination machine 100 according to an embodiment showing the shearing arm 212 mounted along the second side 704 of the ram 102. The drive shaft 712 of the shearing arm 212 is held within a recess 802 of the ram 102. The shear tooling member 714 projects from the drive shaft 712 to the distal end 214 of the shearing arm 212. In an embodiment, the drive shaft 712 includes a dowel rod 804 located at or proximate to a proximal end 806 of the shearing arm 212 (that is opposite to the distal end 214). The termination machine 100 in the illustrated embodiment includes two coil springs 808 held between the dowel rod 804 and a ledge 810 of the ram 102. The ledge 810 faces towards the mounting end 124 of the ram 102. The springs 808 engage the dowel rod 804 to bias the shearing arm 212 relative to the ram 102 in the retracting direction 315 towards the mounting end 124. In an alternative embodiment, the springs 808 may be leaf springs, torsion springs, or the like, instead of coil springs. In yet another embodiment, the termination machine 100 may include an elastic band that pulls the dowel rod 804 towards the mounting end 124 instead of the springs 808 that push the dowel rod 804.

Figure 9:
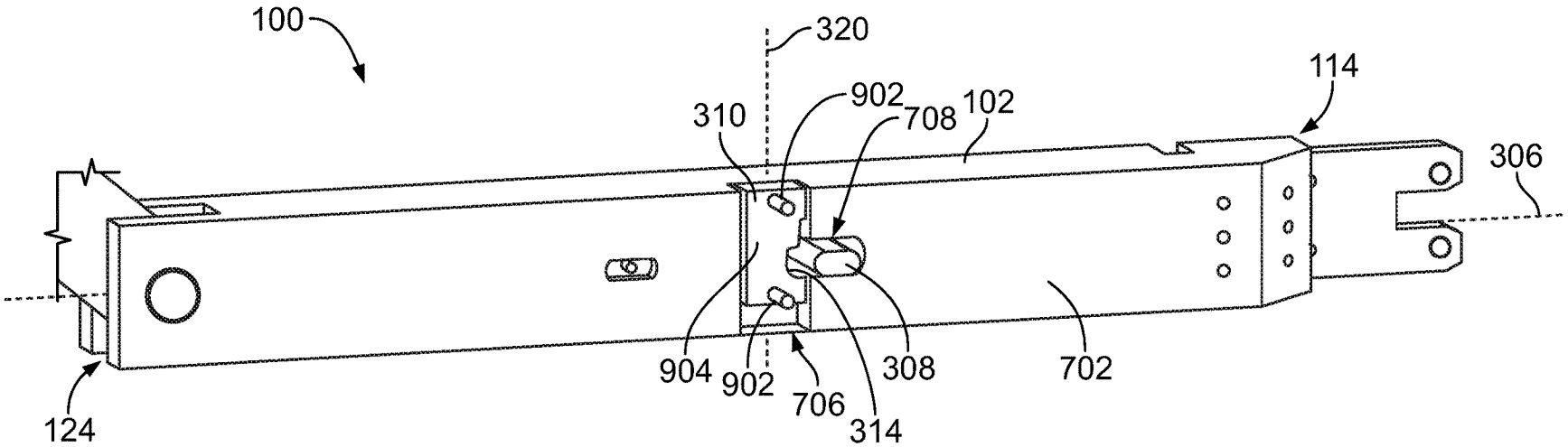
FIG. 9 is a perspective view of a portion of the termination machine according to an embodiment showing a blade switch mounted in a slot along a first side of the ram.

FIG. 9 is a perspective view of a portion of the termination machine 100 according to an embodiment showing the blade switch 310 mounted in the slot 706 along the first side 702 of the ram 102. The slot 706 is sized and shaped to allow the blade switch 310 to move linearly along the switch axis 320, while limiting or preventing movement of the blade switch 310 along the ram axis 306. As shown in FIG. 9, the post 308 of the shearing arm 212 (FIG. 8) extends through the aperture 708 in the ram 102. The blade switch 310 is disposed along the ram axis 306 between the post 308 and the mounting end 124 of the ram 102. The post 308 engages the cam backstop surface 314 of the blade switch 310, which faces towards the crimp end 114. For example, the springs 808 shown in FIG. 8 force the shearing arm 212 towards the mounting end 124 such that the post 308 is pressed against the cam backstop surface 314.

In an embodiment, the blade switch 310 includes two pins 902 that extend from an exposed side 904 of the blade switch 310 and project beyond the first side 702 of the ram 102. The two pins 902 are spaced apart from one another along the switch axis 320. In an alternative embodiment, the blade switch 310 may have only one pin 902 or more than two pins 902, or the blade switch 310 may have another type of protrusion other than cylindrical pins 902.

Figure 10:
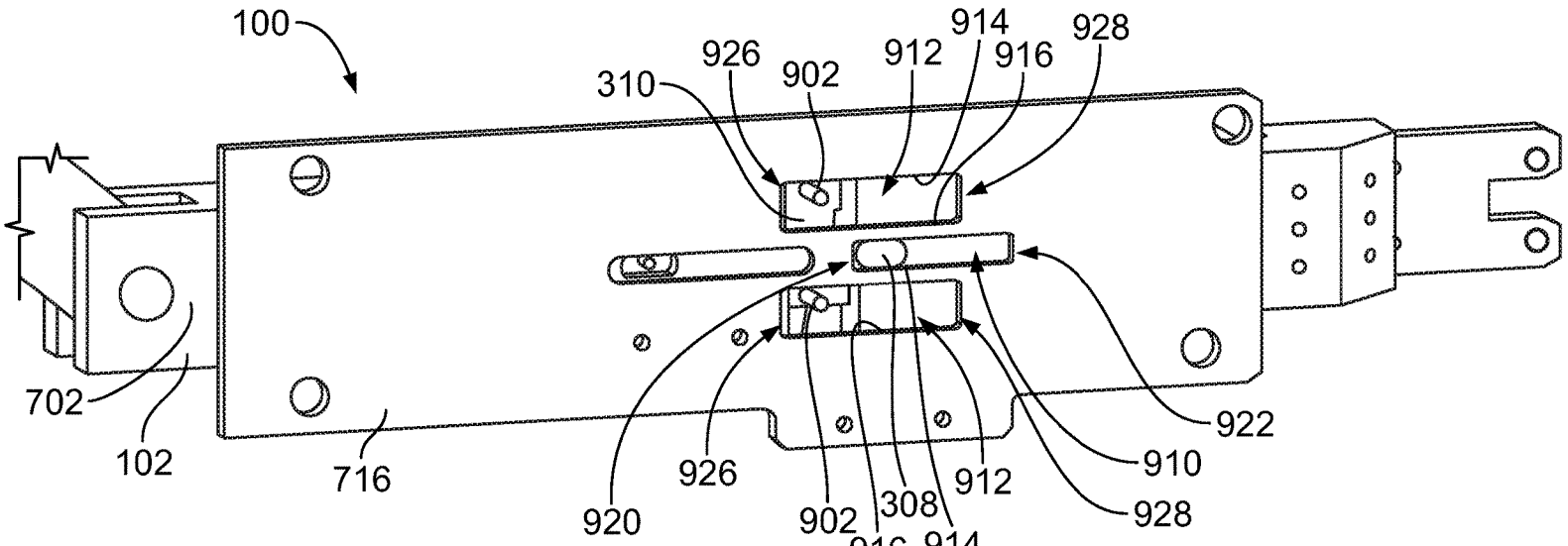
FIG. 10 is a perspective view of a portion of the termination machine according to an embodiment showing a fixed retaining plate and the ram.

FIG. 10 is a perspective view of a portion of the termination machine 100 according to an embodiment showing the fixed retaining plate 716 and the ram 102. The ram 102 is disposed behind the fixed retaining plate 716 in the illustrated embodiment. The fixed retaining plate 716 is disposed adjacent to the first side 702 of the ram 102. The fixed retaining plate 716 may define a limiter slot 910 and two windows 912. The post 308 of the shearing arm 212 (shown in FIG. 8) extends beyond the first side 702 of the ram 102 into the limiter slot 910. Each of the two pins 902 of the blade switch 310 extends through a corresponding one of the windows 912. In an embodiment, the engagement between the pins 902 and upper and lower edges 914, 916 of the windows 912 secures the blade switch 310 to the ram 102. During the crimp stroke, the pins 902 move laterally within the windows 912 relative to the fixed retaining plate 716 between respective back ends 926 and front ends 928 of the windows 912. The post 308 is configured to move laterally within the limiter slot 910 between a back end 920 and a front end 922 of the limiter slot 910. In the illustrated embodiment, the post 308 abuts the back end 920 of the limiter slot 910, and the pins 902 are spaced apart from the back ends 926 of the respective windows 912.

Figure 11:
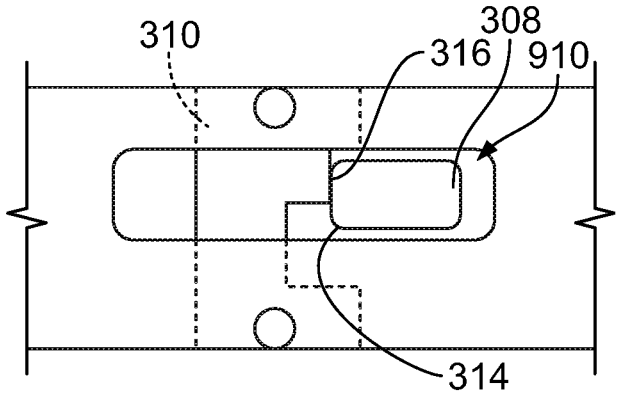
FIG. 11 is a schematic diagram showing a post of the shearing arm and the blade switch according to an embodiment as the ram is at or proximate to the extended position.
Figure 12:
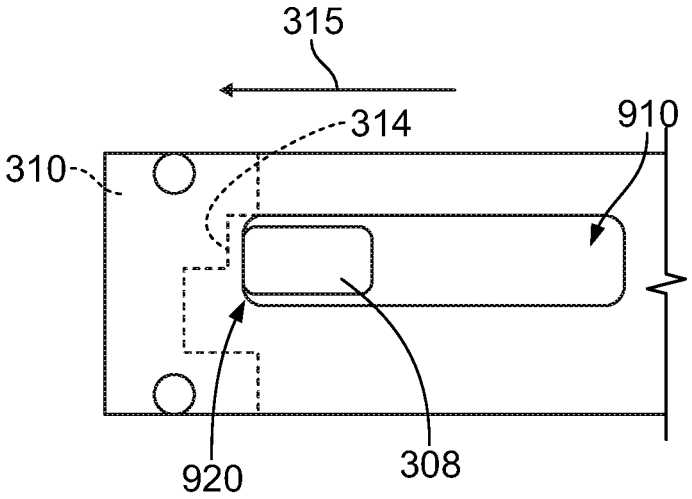
FIG. 12 is a schematic diagram showing the post of the shearing arm and the blade switch according to an embodiment when the ram is at the retracted position.
Figure 13:
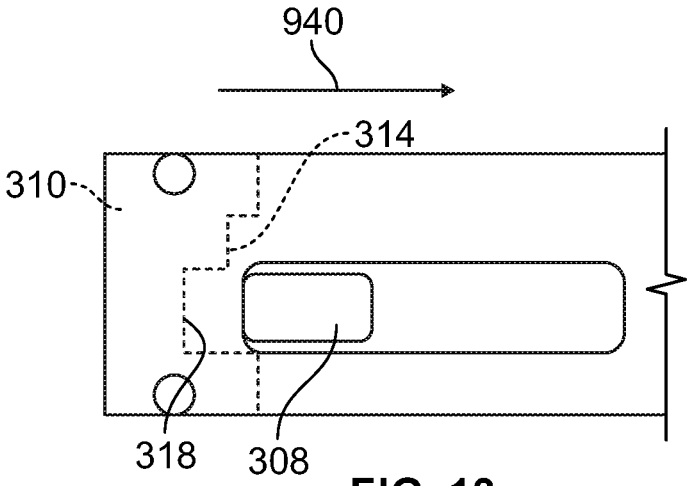
FIG. 13 is a schematic diagram showing the post of the shearing arm and the blade switch according to an embodiment when the ram is at the retracted position, as in FIG. 12, but the blade switch is in a different position relative to the post.

FIGS. 11-13 are schematic diagrams showing the post 308 of the shearing arm 212 (shown in FIG. 8) and the blade switch 310 of the termination machine 100 (shown in FIG. 1) according to an embodiment. For example, FIG. 11 shows the post 308 and the blade switch 310 as the ram 102 (FIG. 8) is at or proximate to the extended position. In the illustrated embodiment, the post 308 engages the high seat 316 of the cam backstop surface 314 of the blade switch 310 and moves with the blade switch 310 along the crimp stroke. The post 308 moves relative to the limiter slot 910 of the fixed retaining plate 716 (FIG. 10).

FIG. 12 shows the post 308 and the blade switch 310 when the ram 102 (FIG. 8) is at the retracted position. As the ram 102 retreats towards the retracted position in the retracting direction 315 relative to the fixed retaining plate 716 (FIG. 10), the post 308 engages the back end 920 of the limiter slot 910. The back end 920 provides a hard stop surface that blocks additional movement of the shearing arm 212 (FIG. 8) with the ram 102 and the blade switch 310 in the retracting direction 315. As the ram 102 continues to move to the retracted position after the post 308 initially engages the back end 920 of the limiter slot 910, the springs 808 (FIG. 8) between the ram 102 and the shearing arm 212 compress. As shown in FIG. 12, when the ram 102 is in the retracted position, the post 308 disengages the cam backstop surface 314 of the blade switch 310. This disengagement allows the blade switch 310 to be toggled relative to the shearing arm 212 without stubbing, rubbing, or other frictional effects between the cam backstop surface 314 and the post 308.

FIG. 13 shows the post 308 and the blade switch 310 when the ram 102 (FIG. 8) is at the retracted position, as in FIG. 12, but the blade switch 310 is moved compared to the position of the post 308 in FIG. 12. For example, the blade switch 310 is shifted upward relative to the post 308 such that the low seat 318 of the cam backstop surface 314 aligns with the post 308. The low seat 318 remains spaced apart from the post 308 until the ram 102 starts moving in an extending direction 940 along the crimp stroke towards the extended position. In an embodiment, the toggle mechanism 302 (shown in FIG. 7) is configured to adjust the position of the blade switch 310 when the ram 102 is in the retracted position. As a result, the toggle mechanism 302 may toggle the shearing arm 212 (FIG. 8) between the cutting and non-cutting positions when the ram 102 is in the retracted position. For example, the toggle mechanism 302 may be configured to not move the blade switch 310 unless the ram 102 is in the retracted position.

Figure 14:
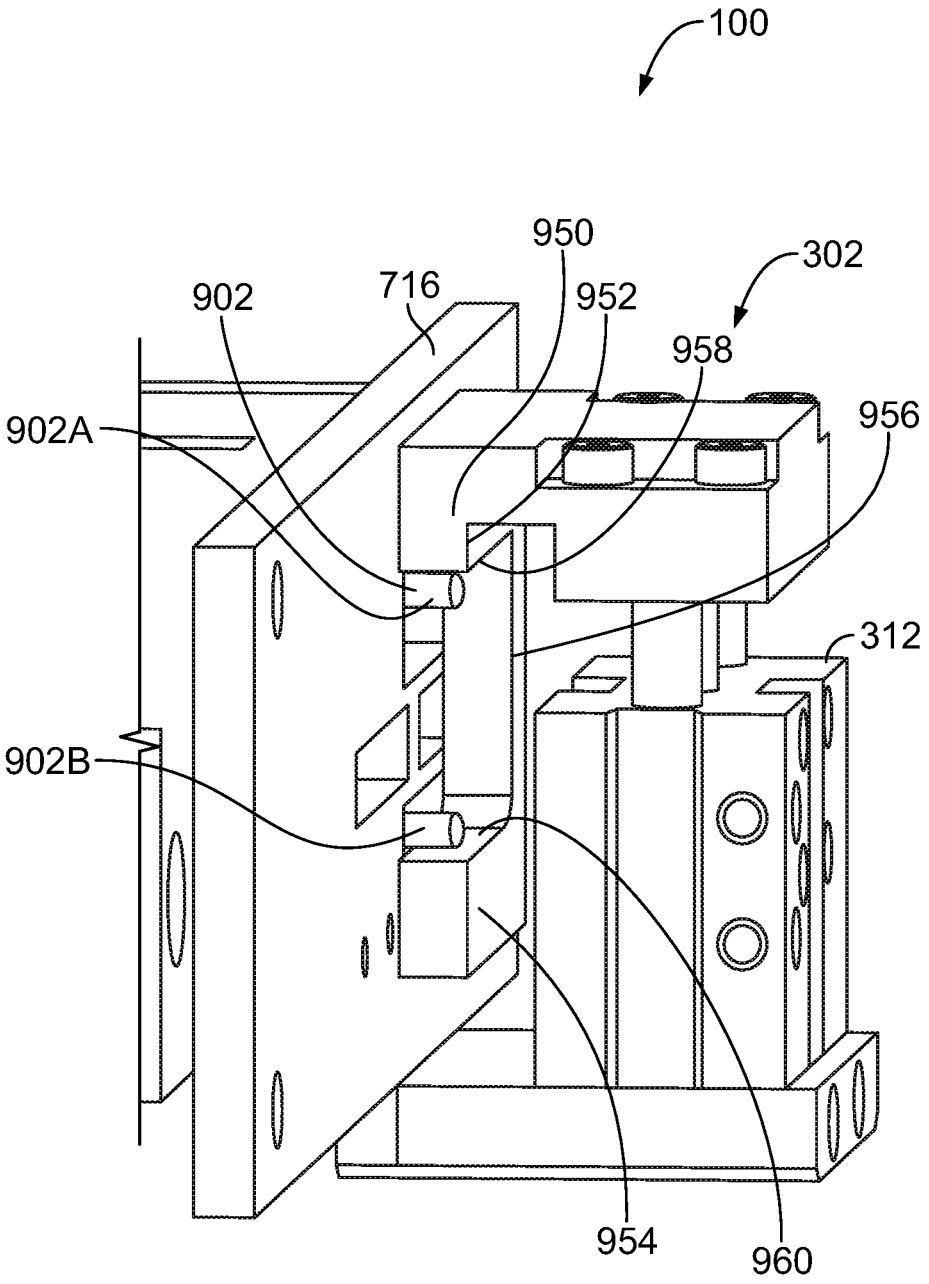
FIG. 14 a perspective view of a portion of the termination machine according to an embodiment showing the fixed retaining plate and an actuator of a toggle mechanism.

FIG. 14 a perspective view of a portion of the termination machine 100 according to an embodiment showing the fixed retaining plate 716 and the actuator 312 of the toggle mechanism 302. In an embodiment, the actuator 312 is operatively connected to the pins 902 of the blade switch 310 (shown in FIGS. 9 and 10) via a shift block 950. The shift block 950 is disposed between the blade switch 310 and the actuator 312. For example, the shift block 950 is coupled to the actuator 312 and directly engages the pins 902. The shift block 950 has a U-shaped body with a first leg 952 and a second leg 954 connected via a bridge 956. An inner surface 958 of the first leg 952 engages a first pin 902A of the two pins 902, and an inner surface 960 of the second leg 954 engages a second pin 902B of the two pins 902. The inner surfaces 958, 960 face each other. As the actuator 312 extends outward (e.g., upward in the illustrated orientation), the inner surface 960 of the second leg 954 pushes the second pin 902B outward in the direction of movement of the actuator 312. Conversely, as the actuator 312 retracts, the inner surface 958 of the first leg 952 pushes the first pin 902A in the direction of movement of the actuator 312.

As used herein, relative or spatial terms such as "front," "rear," "top," "bottom," "high," and "low" are only used to distinguish the referenced elements of the termination machine 100 and do not necessarily require particular positions or orientations relative to gravity and/or relative to the surrounding environment of the termination machine 100.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A termination machine comprising:

a ram that moves reciprocally relative to a stationary anvil between an extended position and a retracted position during a crimp stroke, the ram attached to crimp tooling at a crimp end of the ram, the crimp tooling crimping a terminal against the anvil as the ram moves to the extended position;

a shearing arm mounted to the ram and moving with the ram along a portion of the crimp stroke, the shearing arm including a blade at a distal end thereof and a post projecting laterally from the shearing arm; and a toggle mechanism operatively connected to the post of the shearing arm, the toggle mechanism selectively toggling the shearing arm between a cutting position and a non-cutting position of the shearing arm relative to the ram, the blade of the shearing arm projecting farther beyond the crimp end of the ram in the cutting position than in the non-cutting position.

2. The termination machine of claim 1, wherein, when the shearing arm is in the cutting position, the blade severs a bridge segment of a carrier strip that connects two adjacent terminals to separate the two terminals as the ram moves to the extended position, and, when the shearing arm is in the non-cutting position, the blade is spaced apart from the bridge segment of the carrier strip as the ram moves to the extended position, leaving the bridge segment intact and the two adjacent terminals connected.

3. The termination machine of claim 1, wherein the toggle mechanism includes a powered actuator that moves linearly according to programmed instructions to automatically toggle the shearing arm between the cutting position and the non-cutting position in a designated sequence.

4. The termination machine of claim 1, wherein the toggle mechanism toggles the shearing arm from the cutting position to the non-cutting position and from the non-cutting position to the cutting position while the ram is in the retracted position.

5. The termination machine of claim 1, wherein the ram extends from the crimp end to a mounting end, the shearing arm being biased by one or more springs in a direction towards the mounting end of the ram, the toggle mechanism including a blade switch mounted to the ram between the post of the shearing arm and the mounting end of the ram, the blade switch including a cam backstop surface that engages the post and blocks movement of the shearing arm towards the mounting end.

6. The termination machine of claim 5, wherein the cam backstop surface of the blade switch includes a high seat and a low seat adjacent to the high seat and at a stepped distance from the high seat, wherein the low seat aligns with and engages the post of the shearing arm to position the shearing arm in the non-cutting position and the high seat aligns with and engages the post of the shearing arm to position the shearing arm in the cutting position.

7. The termination machine of claim 5, wherein the shearing arm moves relative to the ram along a ram axis between the cutting and non-cutting positions, the blade switch of the toggle mechanism moving relative to the ram and the post of the shearing arm in a direction perpendicular to the ram axis to toggle the shearing arm between the cutting and non-cutting positions.

8. The termination machine of claim 7, wherein the blade switch engages a powered actuator via a shift block, the powered actuator controlling the movement of the blade switch relative to the ram.

9. The termination machine of claim 1, wherein the post of the shearing arm extends through a limiter slot of a fixed retaining plate, wherein, as the ram moves towards the retracted position, the post abuts an end of the limiter slot to block additional movement of the shearing arm with the ram.

10. The termination machine of claim 9, wherein the toggle mechanism includes a blade switch mounted on the ram, wherein, as the ram moves towards the extended position, the blade switch engages the post of the shearing arm to move the shearing arm with the ram, and wherein, as the ram moves towards the retracted position, the blade switch disengages the post of the shearing arm responsive to the post abutting the end of the limiter slot.

11. A termination machine comprising:

a shearing arm mounted to a ram and moving with the ram towards and away from a stationary anvil along a crimp stroke of the ram, the shearing arm extending to a distal end thereof and including a blade at the distal end that projects beyond a crimp end of the ram, the shearing arm including a post extending laterally from the shearing arm; and a toggle mechanism operatively connected to the post of the shearing arm to selectively toggle the shearing arm between a cutting position and a non-cutting position of the shearing arm relative to the ram, the blade of the shearing arm projecting farther beyond the crimp end of the ram in the cutting position than in the non-cutting position, the toggle mechanism including a blade switch that engages the post and a powered actuator connected to the blade switch, wherein the powered actuator automatically moves the blade switch relative to the ram and the post of the shearing arm between first and second positions of the blade switch to toggle the shearing arm between the cutting position and the non-cutting position.

12. The termination machine of claim 11, further comprising a fixed retaining plate that defines a limiter slot therethrough, the post of the shearing arm extending through the limited slot, wherein, as the ram moves in a direction away from the anvil, the post abuts an end of the limiter slot and the fixed retaining plate blocks additional movement of the shearing arm with the ram in the direction away from the anvil such that the post disengages the blade switch mounted on the ram.

13. The termination machine of claim 11, wherein the shearing arm is biased by one or more springs into engagement with a cam backstop surface of the blade switch.

14. The termination machine of claim 13, wherein the cam backstop surface includes a high seat and a low seat adjacent to the high seat and at a stepped distance from the high seat such that the high seat is closer than the low seat to the anvil, wherein the high seat aligns with and engages the post when the blade switch is in the first position, and the low seat aligns with and engages the post when the blade switch is in the second position.

15. A termination machine comprising:

a ram having a mounting end and a crimp end and extending along a ram axis between the mounting end and the crimp end, the ram moving along a crimp stroke relative to a stationary anvil, the crimp end attached to crimp tooling that crimps a terminal against the anvil;

a shearing arm mounted to the ram, the shearing arm including a blade at a distal end thereof and a post projecting laterally from the shearing arm, the shearing arm biased by one or more springs towards the mounting end of the ram; and a blade switch mounted to the ram between the mounting end and the post of the shearing arm, the blade switch including a cam backstop surface that engages the post of the shearing arm and blocks movement of the shearing arm towards the mounting end, wherein the blade switch is selectively movable perpendicular to the ram axis to toggle the shearing arm between a cutting position and a non-cutting position of the shearing arm relative to the ram, the blade of the shearing arm projecting farther beyond the crimp end of the ram in the cutting position than in the non-cutting position.

16. The termination machine of claim 15, wherein the cam backstop surface of the blade switch includes a high seat and a low seat adjacent to the high seat, the high seat disposed closer than the low seat to the crimp end of the ram, wherein the shearing arm is in the cutting position responsive to the high seat aligning with and engaging the post of the shearing arm, and the shearing arm is in the non-cutting position responsive to the low seat aligning with and engaging the post of the shearing arm.

17. The termination machine of claim 15, wherein, when the shearing arm is in the cutting position, the blade of the shearing arm severs a bridge segment of a carrier strip that connects two adjacent terminals to separate the two terminals as the ram moves along the crimp stroke, and, when the shearing arm is in the non-cutting position, the blade is spaced apart from the bridge segment of the carrier strip as the ram moves along the crimp stroke, leaving the bridge segment intact and the two adjacent terminals connected.

18. The termination machine of claim 15, wherein the blade switch engages a powered actuator via a shift block, the powered actuator automatically controlling the movement of the blade switch perpendicular to the ram axis to toggle the shearing arm between the cutting and non-cutting positions.

19. The termination machine of claim 15, wherein the ram moves along the crimp stroke between a retracted position and an extended position, the ram located closer to the anvil in the extended position than in the retracted position, wherein the post of the shearing arm disengages the cam backstop surface of the blade switch when the ram moves toward the retracted position.

20. The termination machine of claim 15, wherein the ram includes a first side and a second side that is opposite to the first side, the blade switch mounted along the first side of the ram, the shearing arm mounted along the second side of the ram, the post of the shearing arm extending through an aperture of the ram to engage the blade switch along the first side of the ram.

* * * * *